US005937905A

United States Patent [19]

Santos

[11] Patent Number: 5,937,905

[45] Date of Patent: Aug. 17, 1999

[54] FAUCET HEAD THREE-WAY VALVE

[75] Inventor: Robert O. Santos, 12007 Corral Dr., Fairfax Station, Va. 22039

[73] Assignee: Robert O. Santos, Fairfax, Va.

[21] Appl. No.: 08/412,491

[22] Filed: Mar. 28, 1995

[51] Int. Cl.[6] ..... E03C 1/04; F16K 51/00

[52] U.S. Cl. ..... 137/871; 137/801; 4/677; 4/678

[58] Field of Search ..... 137/636, 801, 137/615, 883, 862, 867, 868, 871, 878, 881; 4/678, 567, 615, 675, 676, 677, 568, 570, 569; 239/444, 443

[56] References Cited

U.S. PATENT DOCUMENTS

| | | | |
|---|---|---|---|
| 649,428 | 5/1900 | Barrett | 137/883 |
| 1,377,878 | 10/1921 | French et al. . | |
| 2,314,071 | 3/1943 | Bucknell et al. . | |
| 2,647,536 | 8/1953 | Lunde | 137/636 |
| 4,080,992 | 3/1978 | Niederer | 137/636 |
| 4,590,628 | 5/1986 | DeGregorio | 4/615 |
| 5,123,437 | 6/1992 | Egli et al. . | |
| 5,158,234 | 10/1992 | Magnenat et al. . | |
| 5,213,268 | 5/1993 | Gnauert et al. . | |
| 5,230,106 | 7/1993 | Henkin et al. | 4/615 X |
| 5,329,957 | 7/1994 | Semchuck et al. . | |
| 5,361,431 | 11/1994 | Freier et al. . | |

*Primary Examiner*—Kevin Lee
*Attorney, Agent, or Firm*—Dickinson Wright PLLC

[57] ABSTRACT

A faucet head having at least two different types of outlets, utilizes a three-way valve which permits on-off operation of the faucet distal end. In conjunction with on-off operation, the three-way valve also controls flow of water through one of the faucet head outlets.

12 Claims, 3 Drawing Sheets

FAUCET HEAD THREE-WAY VALVE

FIELD OF THE INVENTION

The present invention is directed a three-way valve for a faucet head.

BACKGROUND ART

In the prior art, it is known to provide a two-way valve in a faucet head such as those typically found in kitchen sink faucets. In these prior art devices, the faucet head has two outlets, one being a spray outlet with the other being a stream outlet. The two-way valve of the prior art permits directing water flow through one of the two outlets.

One of the drawbacks of these types of devices is the need for using both hands if a user wants to operate the two-way valve at the faucet head and either open or close the main faucet valve. Since these two valves are spaced apart, in many instances, both hands are needed for proper operation of the valve. Moreover, since the water cannot be turned off at the faucet head, a user reaching for the main valve may spray water outside of the sink.

In response to this drawback, a need has developed to provide an improved faucet head valve which overcomes the deficiencies in prior art devices.

In response to this need, the present invention provides a three-way faucet head valve which controls on-off operation of the water flow as well as flow between a pair of faucet head outlets.

SUMMARY OF THE INVENTION

Accordingly, it is a first object of the present invention to provide an improved faucet head valve.

Another object of the present invention is to provide a faucet head valve which has a three-way operation so that a user can control on-off flow of water from the faucet as well as flow between two or more outlets.

Another object of the present invention is to provide a faucet head having a simple but effective valve design for a three-way valve operation.

Other objects and advantages of the present invention will become apparent as a description thereof proceeds.

In satisfaction of the foregoing objects and advantages, the present invention provides a faucet head comprising a faucet body having a first passageway therein. An inlet of the first passageway is connectable to a source of liquid. The faucet body can be part of an extensible faucet or fixedly mounted to a sink or the like for rotative movement.

The first passageway diverges into at least a second and third passageway. Each of the second and third passageways have an outlet for liquid discharge. Of course, more then two diverging passageways may be used.

The inventive faucet head also includes a means for blocking flow of a liquid through one or both of the second and third passageways. In this manner, flow of liquid into the faucet body is controlled between a totally off position and a flow position wherein water flows into one of the second or third passageways.

In one embodiment, the inventive means for blocking employs a rocker which positions a valve assembly to totally block flow of liquid or block flow into one of the second or third passageways. The valve assembly can employ a spring biased valve plate which rests against a valve seat for flow blockage. Alternatively, the valve assembly comprises a valve plug employing o-rings for sealing purposes. Each of the valve assemblies is affixed to the rocker, the rocker positionable between a closed position and two on positions for directing water to one of the outlets. Valve stems of the valve assemblies are attached to the rocker so that movement thereof causes the desired valve operation.

BRIEF DESCRIPTION OF THE DRAWINGS

Reference is now made to the drawings of the invention wherein.

DESCRIPTION OF THE PREFERRED EMBODIMENTS

The present invention is an improvement over prior art devices which require on-off valve operation at a handle located remotely from the faucet head. With these prior art devices, it is difficult or awkward to turn the water off when using the faucet in a position remote from its base.

The present invention overcomes this problem by providing three-way faucet operation at the faucet head. With the inventive valve, a user, with one hand, can control both on-off operation of the faucet and selection of a desired type of water flow, for example, spray or stream.

Figure 1:
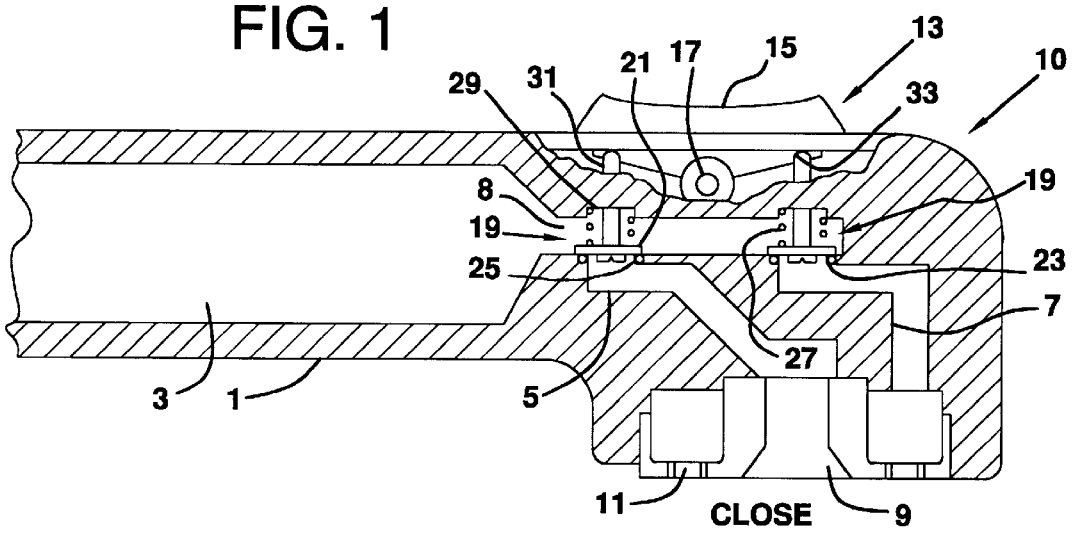
FIG. 1 is a cross-sectional view of a first embodiment of the inventive faucet head.

With reference now to FIG. 1, one embodiment of the inventive faucet head is generally designated by the reference numeral 10 and is seen to include a faucet body 1 having a passageway 3 therein. The faucet body 1 is attached to a faucet base (not shown) as is known in the art. The passageway 3 is in communication at its inlet with a source of water, the source typically controlled by a main faucet valve or the like.

The passageway 3 splits or diverges into two separate passageways, 5 and 7 via connecting passageway 8 which may be tubular or be cylindrical in shape when viewed from the faucet head top. Passageway 5 terminates in a stream outlet 9 with passageway 7 terminating in an annular spray outlet 11. Of course, the outlets may be a part of each passageway.

The faucet body 1 includes a three-way valve designated by the reference numeral 13. The three-way valve 13 includes a rocker 15 which is pivotally attached to the faucet body 1 at reference numeral 17.

A pair of valve assemblies 19 are provided which control flow of water in the passageway 3 to either of the passageways 5 and 7. The valve assembly 19 includes a valve plate 21 having an o-ring 23. The valve plate 21 and o-ring 23 are sized to seat in the valve seat 25 at the junction of each of the passageways 5 and 7 with the passageway 3.

The valve assembly 19 also includes a spring 27 which is positioned between the recess 29 in the faucet body 1 and the valve plate 21. The spring 27 biases the valve plate 21 downwardly to block communication between the passageway 3 and passageways 5 and 7.

A valve stem 31 is fixed to the rocker arm 15 at reference numeral 33. The valve stem 31 is slidably mounted to the valve plate 21 and retained by the stem head 35. The spring 27 biases the valve plate 21 against the stem head 35 when the valve assembly is lifted.

In FIG. 1, the three-way valve 13 is shown in the closed position so that flow of water in the passageway 3 is blocked from exiting via either outlet 9 or 11. The rocker 15 is positioned in its middle position in this closed position.

Figure 2:
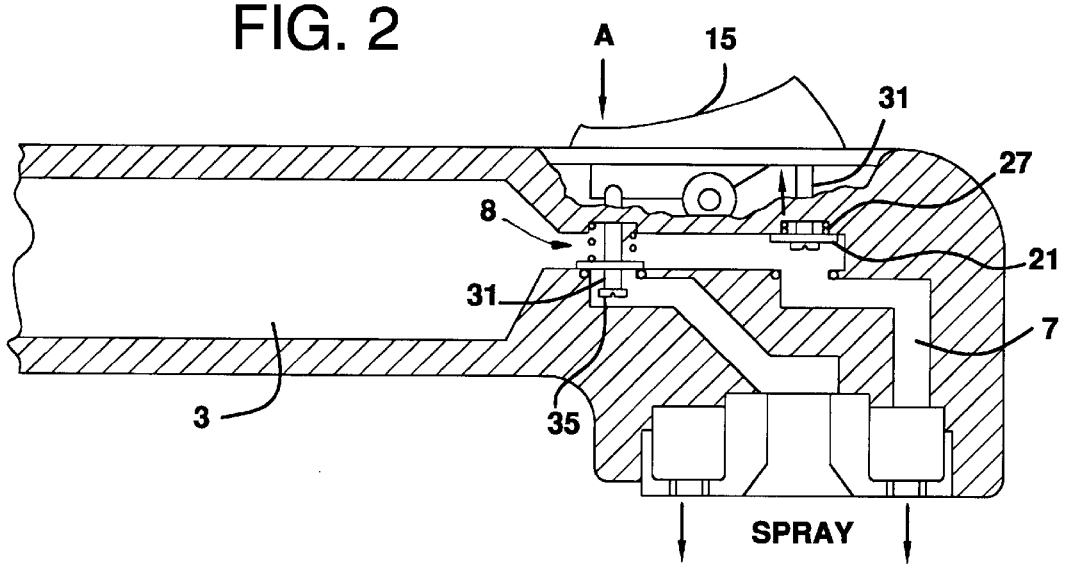
FIGS. 2 and 3 show the embodiment of FIG. 1 in exemplary uses.

With reference to FIG. 2, the rocker 15 is depressed in the direction represented by the arrow A. This rocker movement translates one of the valve stems 31 downwardly with the other valve stem 31 moving upwardly. This upward movement causes the stem head 35 to raise the valve plate 21 to provide communication between the passageways 3 and 7. In this valve position, a spray emanates from the faucet body 1.

Figure 3:
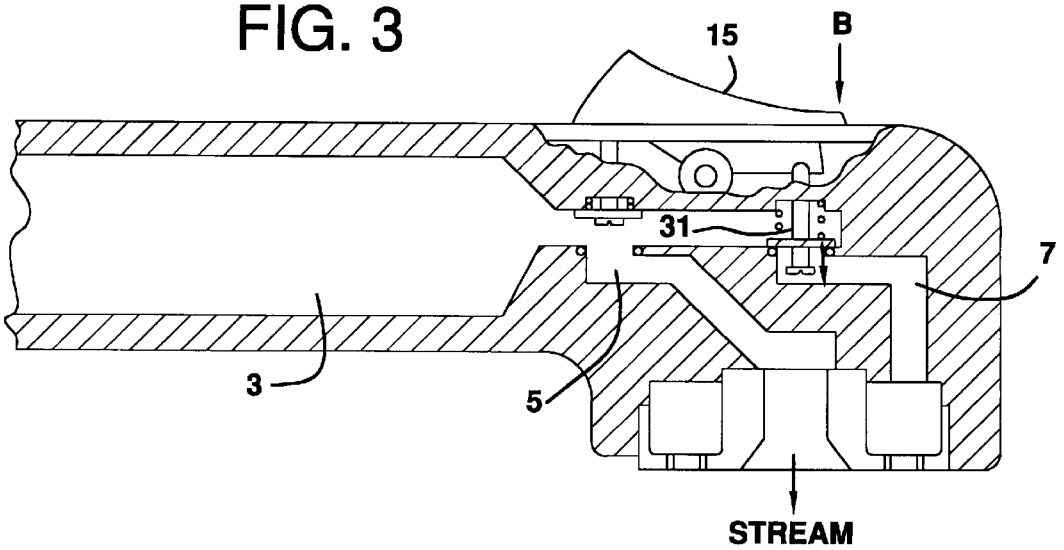

Referring to FIG. 3, the rocker arm is moved in the direction represented by the arrow B. By this movement, the passageway 7 is blocked and the passageway 5 is open for flow of water from the faucet head as a stream.

Figure 4:
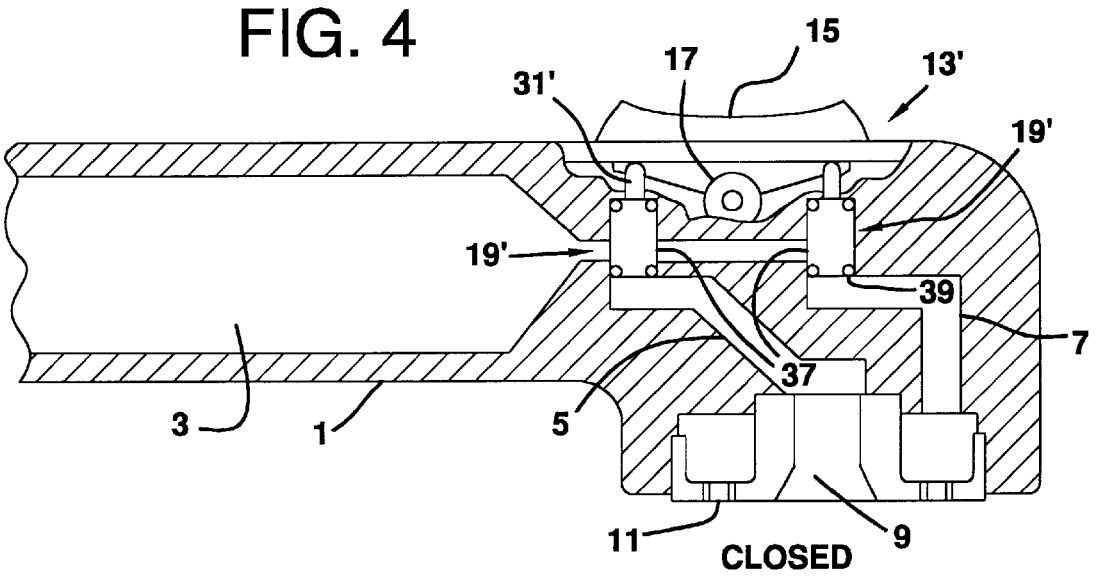
FIG. 4 is a cross-sectional view of a second embodiment of the inventive faucet head.

With reference to FIG. 4, a second embodiment of the inventive three-way valve is general designated by the reference numeral 13'. In this embodiment, valve plugs 37 are employed for flow control. The valve plugs 37 have o-rings at their ends for sealing purposes. Each of the valve plugs 37 is affixed to the rocker arm 15 via the valve stem 31'.

Figure 5:
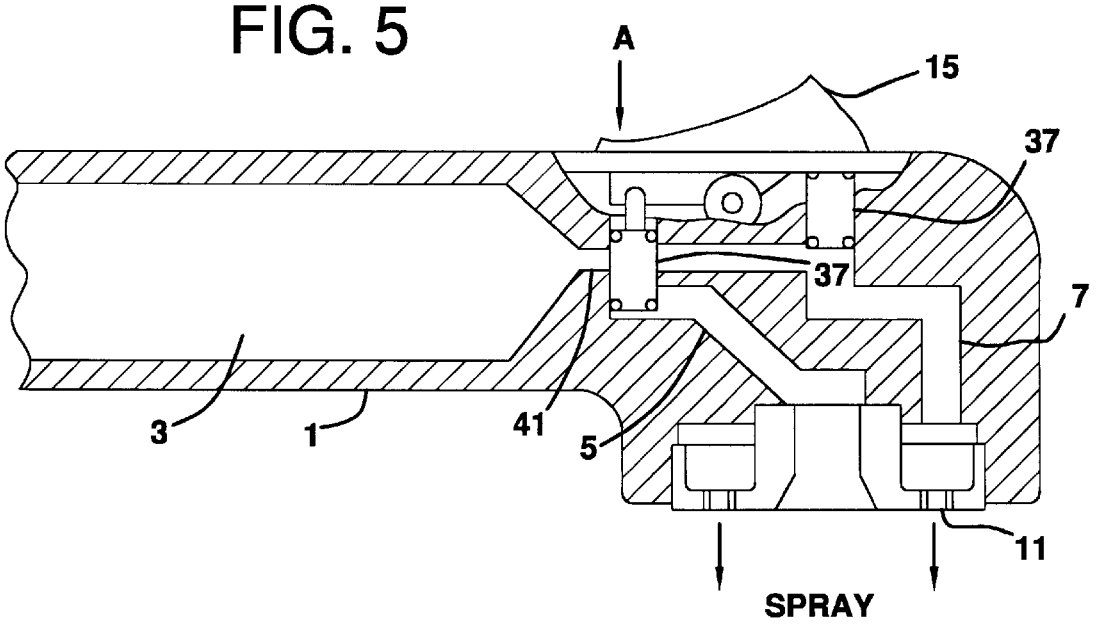
FIGS. 5 and 6 show the embodiment of FIG. 4 in exemplary uses.

In operation, referring to FIG. 5, depression of the rocker 15 in the direction represented by the letter A opens passageway 7 for spray flow.

Figure 6:
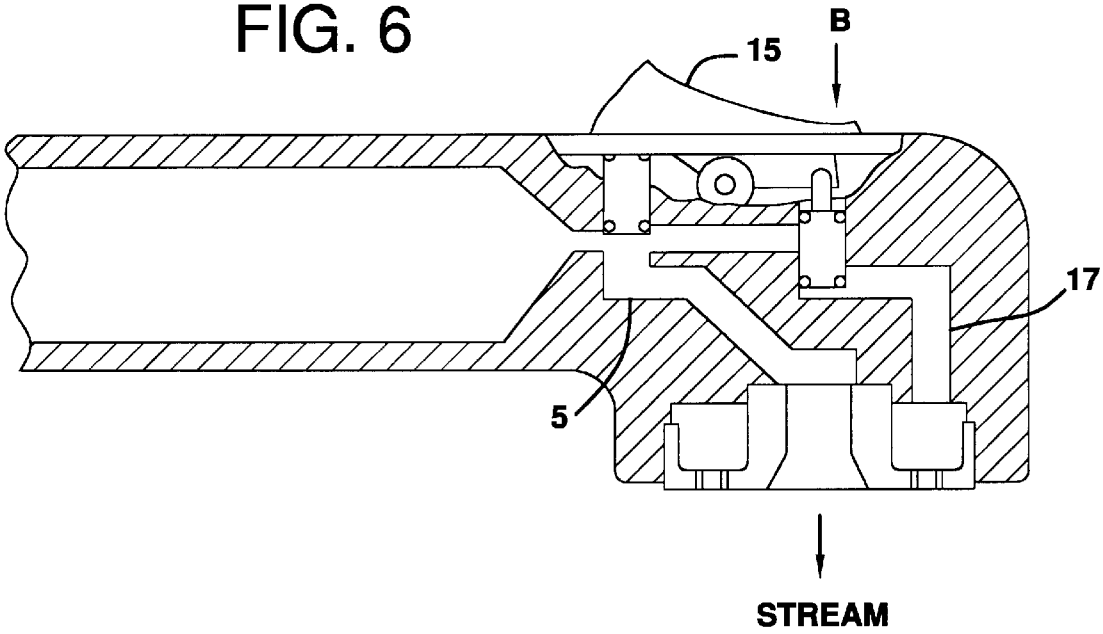

FIG. 6 shows depression of the rocker 15 in a direction represented by the letter B. This rocker movement opens the passageway 5 for stream flow. In each of FIGS. 5 and 6, the valve plug 37 is raised and lowered to open one of the passageways 5 and 7 and close the other.

It should be understood that the passageway 8, see FIG. 5, is sized to let water flow around the plug 37 so that it can enter passageway 7 and the stream outlet 11. Preferably, the passageway 8, when viewed in cross-section perpendicularly to the section shown in FIG. 5, is rectangular in shape to provide sufficient water flow to the spray head 11. Of course, any configuration of the passageway 8 can be utilized in the inventive faucet head.

Figure 7:
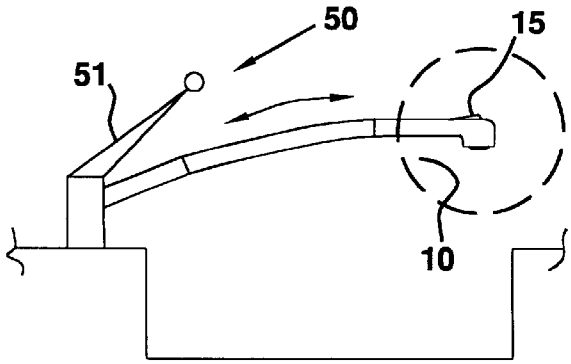
FIG. 7 shows an alternative mounting arrangement for the inventive faucet head.

FIG. 7 shows an exemplary embodiment for using the inventive faucet head 10. In this figure, the faucet head is combined with an extensible faucet designated by the reference numeral 50. Using the inventive faucet head, a user does not have to reach for the handle 51 to shut off the water supply to the faucet head 10. A user merely has to move the rocker 15 to its middle position to stop water flow.

It should be understood that the valve assemblies 19 and 19' depicted in FIGS. 1 and 4 are merely exemplary of means for blocking the flow of fluid into one or more of the passageways 5 and 7. For example, although a pivoting rocker is shown for valve displacement, other means that employ rotational movement or the like could also be utilized to achieve the three-way valve operation. Likewise, the configuration of the various passageways depicted in FIGS. 1 and 4 are exemplary and other paths and path sizes may be utilized in conjunction with the inventive three-way valve.

As such, an invention has been disclosed in terms of preferred embodiments thereof which fulfills each and every one of the objects of the present invention as set forth hereinabove and provides a new and improved faucet head.

Of course, various changes, modifications and alterations from the teachings of the present invention may be contemplated by those skilled in the art without departing from the intended spirit and scope thereof. Accordingly, it is intended that the present invention only be limited by the terms of the appended claims.

I claim:

1. An extensible kitchen faucet comprising:

a) a kitchen faucet base having an temperature control valve and a hollow member extending therefrom;

b) an extensible kitchen faucet head, said extensible kitchen faucet head connectable to the kitchen faucet base and including a flexible conduit sized to slide in and out of the hollow member, said flexible conduit connectable to a source of liquid, said extensible kitchen faucet head further comprising a kitchen faucet body having;

i) a first passageway therein, an inlet of said first passageway connected to said flexible conduit, said first passageway diverging into a second and a third passageway, each of said second and third passageways having an outlet for liquid discharge; and ii) means for blocking flow of said liquid through one of and both of said second and third passageways.

2. The extensible kitchen faucet of claim 1, wherein said third passageway connects to a spray head outlet and said second passageway connects to a stream head outlet.

3. The extensible kitchen faucet of claim 1, wherein said second and third passageways connect to said first passageway perpendicularly to their respective longitudinal axes.

4. The extensible kitchen faucet of claim 1, wherein said faucet body is elongated and said means for blocking flow of said liquid is positioned at a distal end of said faucet body.

5. The extensible kitchen faucet of claim 1, wherein said third passageway connects to an annular outlet which surrounds an outlet of said second passageway.

6. The extensible kitchen faucet of claim 1, wherein said means for blocking flow of said liquid further comprises:

i) a first spring loaded valve positioned in said faucet body to control flow of said liquid between said first passageway and said second passageway;

ii) a second spring loaded valve positioned in said faucet body to control flow of said liquid between said first passageway and said third passageway;

iii) a rocker, each of said first spring loaded valve and said second spring loaded valve pivotally attached to said rocker;

iv) wherein each of said first and second spring loaded valves are spring biased to block said second and third passageway, respectively, when said rocker is at rest, movement of said rocker lifting one of said first and said second spring loaded valves to provide fluid flow through one of said second and said third passageways, respectively.

7. The extensible kitchen faucet of claim 6, further comprising a valve seat at a junction between said first passageway and each of said second and third passageways, each said valve seat sized to receive one of said spring loaded valves for blocking of said liquid.

8. The extensible kitchen faucet of claim 6, wherein said rocker is pivotably mounted to said faucet body to facilitate said movement.

9. The extensible kitchen faucet of claim 1, wherein said means for blocking flow of said liquid further comprises:

i) a first valve positioned in said faucet body to control flow of said liquid between said first passageway and said second passageway;

ii) a second valve positioned in said faucet body to control flow of said liquid between said first passageway and said third passageway;

iii) a rocker, each of said first valve and said second valve pivotally attached to said rocker;

iv) wherein each of said first and second valves are positioned to block said second and third passageways, respectively, when said rocker is at rest, movement of said rocker lifting one of said first and said second valves to provide fluid flow through one of said second and said third passageways, respectively.

10. The extensible kitchen faucet of claim 9, wherein each of said first and second valves include o-rings.

11. The extensible kitchen faucet of claim 9, further comprising a valve seat at a junction between said first passageway and each of said second passageway and said third passageway, each said valve seat sized to receive one of said first and second valves for blocking of said liquid.

12. The extensible kitchen faucet of claim 9, wherein said rocker is pivotably attached to said faucet body to facilitate said movement.

* * * * *